US006269658B1

(12) United States Patent
Royal et al.

(10) Patent No.: US 6,269,658 B1
(45) Date of Patent: Aug. 7, 2001

(54) CRYOGENIC RECTIFICATION SYSTEM WITH PULSE TUBE REFRIGERATION

(75) Inventors: John Henri Royal, Grand Island; Arun Acharya, East Amherst; Christian Friedrich Gottzmann, Clarence; Dante Patrick Bonaquist; Bayram Arman, both of Grand Island; Joseph Alfred Weber, Cheektowaga, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/604,912

(22) Filed: Jun. 28, 2000

(51) Int. Cl.[7] ..... F25B 9/00; F25J 3/00
(52) U.S. Cl. ..... 62/643; 62/6; 62/912
(58) Field of Search ..... 62/6, 643, 623, 62/912

(56) References Cited

U.S. PATENT DOCUMENTS 5,711,156 1/1998 Matsui et al. ..... 62/6
6,053,008 4/2000 Arman et al. ..... 62/646

FOREIGN PATENT DOCUMENTS 2751060 1/1998 (FR) .

*Primary Examiner*—William Doerrler
(74) *Attorney, Agent, or Firm*—Stanley Ktorides

(57) ABSTRACT

A cryogenic rectification system wherein some or all of the refrigeration necessary to drive the rectification is generated by providing a pulse to a gas and then passing the compressed gas to a pulse tube wherein the gas expands in a wave generating refrigeration at one end of the pulse tube for transfer into the rectification system.

13 Claims, 4 Drawing Sheets

CRYOGENIC RECTIFICATION SYSTEM WITH PULSE TUBE REFRIGERATION

TECHNICAL FIELD

This invention relates generally to cryogenic rectification and is particularly useful for carrying out cryogenic air separation.

BACKGROUND ART

Cryogenic rectification, such as the cryogenic rectification of feed air, requires the provision of refrigeration to drive the separation. Generally such refrigeration is provided by the turboexpansion of a process stream, such as, for example, a portion of the feed air. While this conventional practice is effective, it is limiting because any change in the requisite amount of refrigeration inherently affects the operation of the overall process. It is therefor desirable to have a cryogenic rectification system wherein the provision of the requisite refrigeration is independent of the flow of process streams for the system.

One method for providing refrigeration for a cryogenic rectification system which is independent of the flow of internal system process streams is to provide the requisite refrigeration in the form of cryogenic liquid brought into the system. Unfortunately such a procedure is very costly.

Accordingly it is an object of this invention to provide an improved cryogenic rectification system wherein the provision of at least some of refrigeration for the separation is independent of the turboexpansion of process streams and does not require the provision of exogenous cryogenic liquid to the system.

SUMMARY OF THE INVENTION

The above and other objects, which will become apparent to those skilled in the art upon a reading of this disclosure, are attained by the present invention, one aspect of which is:

A method for carrying out cryogenic rectification comprising:

(A) passing feed into a cryogenic rectification plant comprising at least one column;

(B) applying a compressive force to a pulse tube system gas to compress the pulse tube system gas, passing the compressed pulse tube system gas to a pulse tube, and expanding the pulse tube system gas within the pulse tube to generate refrigeration;

(C) passing refrigeration generated by the pulse tube system gas into the cryogenic rectification plant; and (D) separating the feed by cryogenic rectification within the cryogenic rectification plant using refrigeration generated by the pulse tube system gas.

Another aspect of the invention is:

Apparatus for carrying out cryogenic rectification comprising:

(A) a cryogenic rectification plant comprising at least one column and means for passing feed into the cryogenic rectification plant;

(B) a pulse tube refrigeration system comprising a precooling means, a pulse tube, means for passing pulse tube system gas from the precooling means to the pulse tube, and means for applying a compressive force to the pulse tube system gas;

(C) means for passing refrigeration from the pulse tube refrigeration system into the cryogenic rectification plant; and (D) means for recovering product from the cryogenic rectification plant.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the more volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases can be adiabatic or nonadiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other. As used herein the term "product nitrogen" means a fluid having a nitrogen concentration of at least 95 mole percent.

As used herein the term "product oxygen" means a fluid having an oxygen concentration of at least 85 mole percent.

As used herein the term "product argon" means a fluid having an argon concentration of at least 90 mole percent.

As used herein the term "feed air" means a mixture comprising primarily oxygen, nitrogen and argon, such as ambient air.

As used herein the terms "upper portion" and "lower portion" mean those sections of a column respectively above and below the mid point of the column.

DETAILED DESCRIPTION

The invention will be described in greater detail with reference to the Drawings and wherein the cryogenic rectification is a cryogenic air separation system wherein feed air is separated by cryogenic rectification to produce at least one of product nitrogen, product oxygen and product argon.

Figure 1:
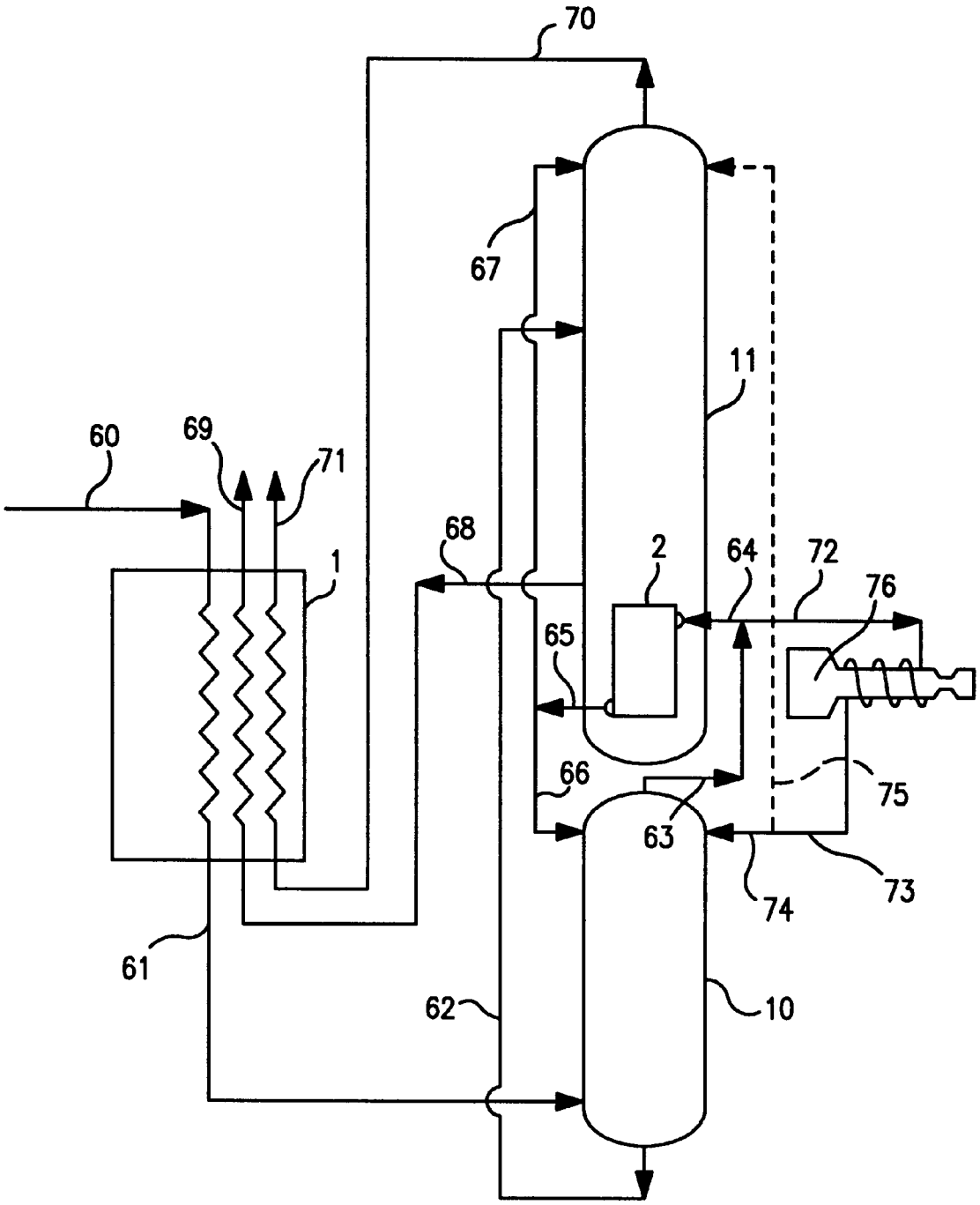
FIG. 1 is a schematic representation of one preferred embodiment of the invention wherein the cryogenic rectification plant is a double column air separation plant and refrigeration is passed from the pulse tube system into the plant using higher pressure column shelf vapor.

Referring now to FIG. 1, feed air 60, which has been cleaned of high boiling impurities such as carbon dioxide, water vapor and hydrocarbons, is cooled by passage through main heat exchanger 1 by indirect heat exchange with return streams. Resulting cooled feed air 61 is passed into higher pressure column 10 which is part of a double column which also includes lower pressure column 11. Column 10 is operating at a pressure generally within the range of from 50 to 250 pounds per square inch absolute (psia). Within higher pressure column 10 the feed air is separated by cryogenic rectification into nitrogen-enriched vapor and oxygen-enriched liquid.

Oxygen-enriched liquid is withdrawn from the lower portion of column 10 in stream 62 and passed into lower pressure column 11. Nitrogen-enriched vapor is withdrawn from the upper portion of column 10 in stream 63 and, in the embodiment of the invention illustrated in FIG. 1, is divided into streams 64 and 72. Stream 64 is passed into main condenser 2 wherein it is condensed by indirect heat exchange with boiling lower pressure column bottom liquid. Resulting condensed nitrogen-enriched liquid is withdrawn from main condenser 2 in stream 65. A portion 66 of the nitrogen-enriched liquid is passed into the upper portion of column 10 as reflux and another portion 67 of the nitrogen-enriched liquid is passed into the upper portion of column 11 as reflux.

Lower pressure column 11 is operating at a pressure less than that of higher pressure column 10 and generally within the range of from 15 to 25 psia. Within lower pressure column 11 the fluids passed into that column are separated by cryogenic rectification to produce nitrogen-rich fluid and oxygen-rich fluid which may be recovered as product nitrogen and/or product oxygen respectively. In the embodiment illustrated in FIG. 1, nitrogen-rich vapor is withdrawn from the upper portion of column 11 in stream 70, warmed by passage through main heat exchanger 1, and recovered as product nitrogen in stream 71. Oxygen-rich vapor is withdrawn from the lower portion of column 11 in stream 68, warmed by passage through main heat exchanger 1, and recovered as product oxygen in stream 69.

Figure 4:
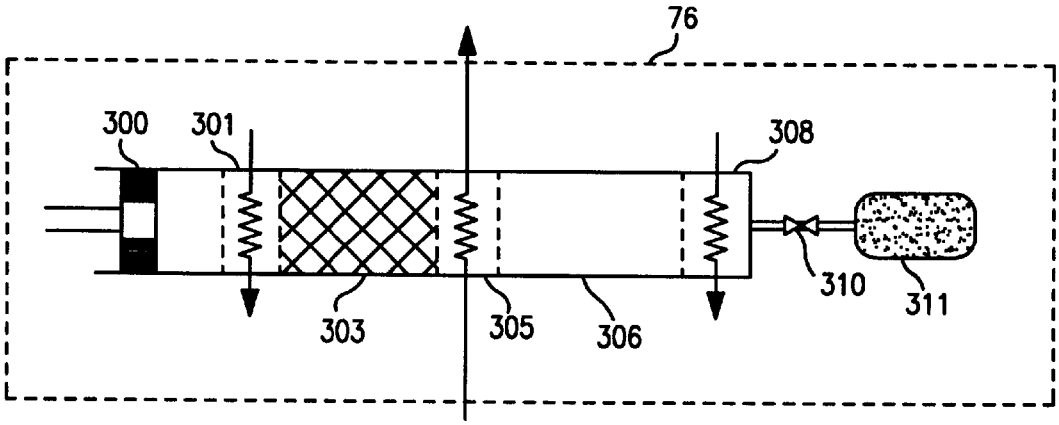
FIG. 4 is a more detailed representation of one embodiment of the pulse tube refrigeration system useful in the practice of this invention.

At least some, and preferably all, of the refrigeration necessary to drive the cryogenic rectification within the column is generated by the pulse tube refrigeration system one embodiment of which is illustrated in FIG. 4.

Referring now to FIG. 4, pulse tube refrigeration system 76 is a closed refrigeration system that pulses a refrigerant, i.e. a pulse tube system gas, in a closed cycle and in so doing transfers a heat load from a cold section to a hot section. The frequency and phasing of the pulses is determined by the configuration of the system. The motion of the gas is generated by a piston of a compressor or some other acoustic-wave generation device 300 to generate a pressure wave within the volume of gas. The compressed gas flows through an aftercooler 301, which removes the heat of compression. The compressed refrigerant then flows through a precooling means, such as regenerator section (303), cooling as it passes through. A recuperator or other cooler may also be used as the precooling means in the practice of this invention. The regenerator precools the incoming high-pressure working fluid before it reaches the cold end. The working fluid enters the cold heat exchanger 305 then pulse tube 306, and compresses the fluid residing in the pulse tube towards the hot end of the pulse tube. The warmer compressed fluid within the warm end of the pulse tube passes through the hot heat exchanger 308 and then into the reservoir 311. The gas motion, in phase with the pressure, is accomplished by incorporating an orifice 310 and a reservoir volume where the gas is stored during a half cycle. The size of the reservoir 311 is sufficient so that essentially no pressure oscillation occurs in it during the oscillating flow. The oscillating flow through the orifice causes separation of the heating and cooling effects. The inlet flow from the wave-generation device/piston 300 stops and the tube pressure decreases to a lower pressure. Gas from the reservoir 311 at an average pressure cools as it passes through the orifice to the pulse tube, which is at the lower pressure. The gas at the cold end of the pulse tube 306 is adiabatically cooled below to extract heat from the cold heat exchanger. The lower pressure working fluid is warmed within regenerator 303 as it passes into the wave-generating device/piston 300. The orifice pulse tube refrigerator functions ideally with adiabatic compression and expansion in the pulse tube. The cycle is as follows: The piston first compresses the gas in the pulse tube. Since the gas is heated the compressed gas is at a higher pressure than the average pressure in the reservoir it flows through the orifice into the reservoir and exchanges heat with the ambient through the heat exchanger located at the warm end of the pulse tube. The flow stops when the pressure in the pulse tube is reduced to the average pressure. The piston moves back and expands the gas adiabatically in the pulse tube. The cold, low-pressure gas in the pulse tube is forced toward the cold end by the gas flow from the reservoir into the pulse tube through the orifice. As the cold refrigerant passes through the heat exchanger at the cold end of the pulse tube, it removes the heat from the object being cooled. The flow stops when the pressure in the pulse tube increases to the average pressure. The cycle is then repeated.

Nitrogen-enriched vapor stream 72 is passed in indirect heat exchange relation with pulse tube refrigeration system 76, whereby refrigeration is passed from the pulse tube refrigeration system into the nitrogen-enriched vapor which is condensed and subcooled, as illustrated in FIG. 1. Resulting condensed nitrogen-enriched liquid 73 is passed into at least one, or both, of columns 10 and 11 thereby serving to pass refrigeration generated by the pulse tube refrigeration system into the cryogenic rectification plant. In the embodiment of the invention illustrated in FIG. 1, the condensed nitrogen-enriched liquid in stream 73 is shown as being passed into the upper portion of column 10 as additional reflux in stream 74, and optionally into the upper portion of column 11 as additional reflux as illustrated by broken line 75.

Figure 2:
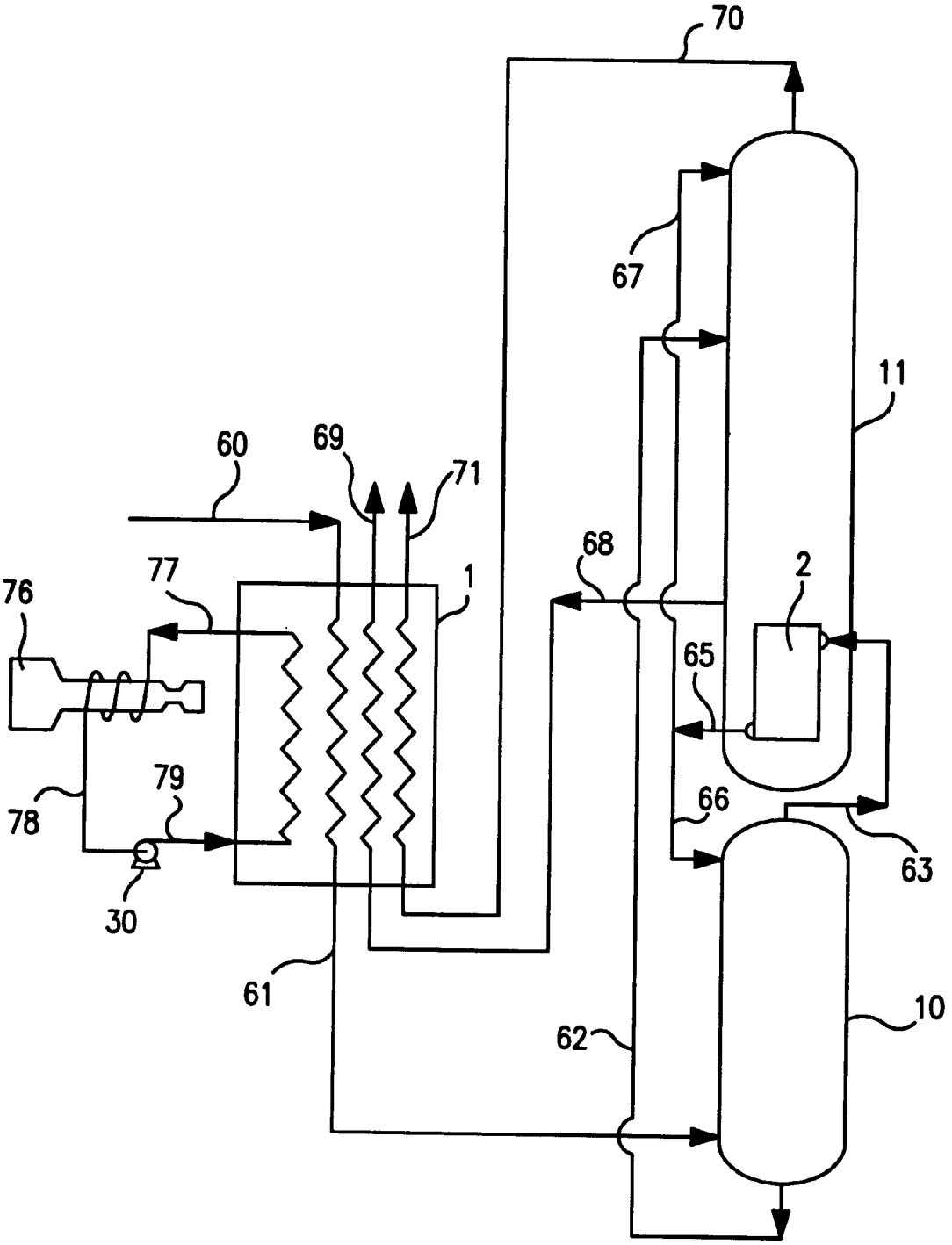
FIG. 2 is a schematic representation of another preferred embodiment of the invention wherein the cryogenic rectification plant is a double column air separation plant and refrigeration is passed from the pulse tube system into the plant using the feed air.

FIG. 2 illustrates another embodiment of the invention wherein refrigeration generated by the pulse tube refrigeration system is passed into the feed, in this case feed air, and with the feed this refrigeration is passed into the cryogenic rectification plant to drive the separation. In the embodiment of the invention illustrated in FIG. 2, nitrogen-enriched vapor stream 63 is passed into main condenser 2. Some of this nitrogen-enriched vapor stream 63 may be taken as a high pressure product after being warmed within primary heat exchanger 1. The numerals of FIG. 2 are the same as those of FIG. 1 for the common elements and these common elements will not be described again in detail.

Referring now to FIG. 2, heat exchange fluid in stream 77 is passed into indirect heat exchange relation with pulse tube refrigeration system 76 whereby it is cooled by the passage of refrigeration from the pulse tube refrigeration system into the heat exchange fluid. Examples of useful heat exchange fluids include helium, neon, nitrogen, argon, krypton, xenon, carbon tetrafluoride, fluorocarbons, fluoroethers and mixtures thereof. Resulting cooled heat exchange fluid 78 is pumped through pump 30 and as stream 79 is passed into main heat exchanger 1 wherein it is warmed by indirect heat exchange with feed air 60. In this way refrigeration generated by the pulse tube refrigeration system is passed into the feed air and then into the cryogenic air separation plant. The feed air 61, which has been cooled and may be partially condensed by the indirect heat exchange both with the return streams and with the heat exchange fluid, is then passed into column 10 for processing as was previously described. Resulting warmed heat exchange fluid 77 is passed from main heat exchanger 1 to pulse tube refrigeration system 76 as was previously described.

Figure 3:
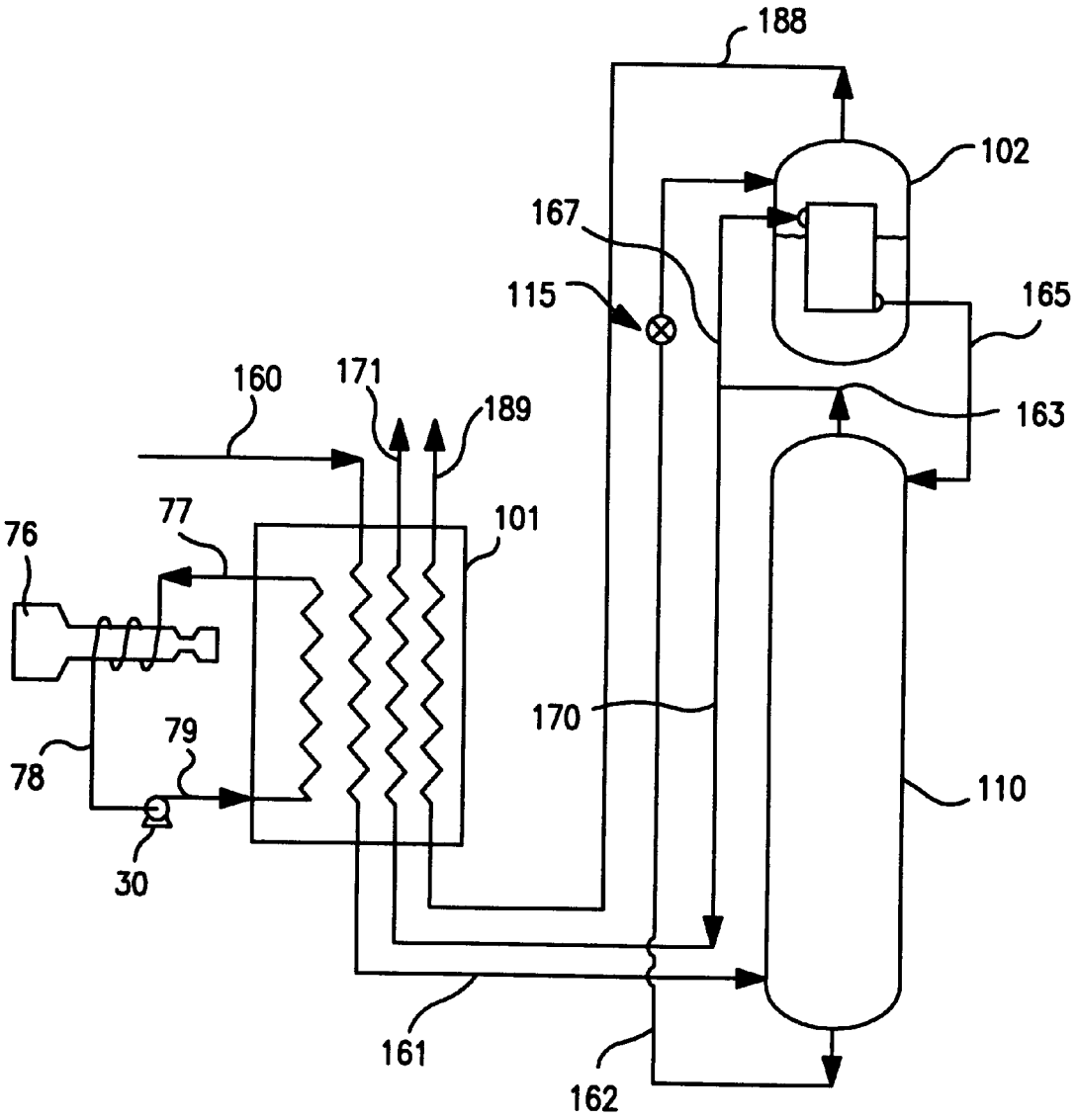
FIG. 3 is a schematic representation of another preferred embodiment of the invention wherein the cryogenic rectification plant is a single column air separation plant and refrigeration is passed from the pulse tube system into the plant using the feed air.

FIG. 3 illustrates the operation of the invention in conjunction with a single column cryogenic rectification plant. The particular system illustrated in FIG. 3 is a single column cryogenic air separation plant for the production of product nitrogen.

Referring now to FIG. 3, feed air 160, which has been cleaned of high boiling impurities such as carbon dioxide, water vapor and hydrocarbons, is cooled by passage through main heat exchanger 101 by indirect heat exchange with return streams and with heat exchange fluid. Resulting cooled feed air 161 is passed into column 110 which is operating at a pressure generally within the range of from 50 to 250 (psia). Within column 110 the feed air is separated by cryogenic rectification into nitrogen-enriched vapor and oxygen-enriched liquid.

Oxygen-enriched liquid is withdrawn from the lower portion of column 110 in stream 162 and passed through valve 115 and into top condenser 102. Nitrogen-enriched vapor is withdrawn from the upper portion of column 110 in stream 163 and is divided into streams 170 and 167. Stream 167 is passed into top condenser 102 wherein it is condensed by indirect heat exchange with the oxygen-enriched liquid. Resulting condensed nitrogen-enriched liquid is passed from top condenser 102 in stream 165 as reflux into the upper portion of column 110. Stream 170 is warmed by passage through main heat exchanger 101 and recovered as product nitrogen in stream 171. Oxygen-enriched vapor which results from the heat exchange in top condenser 102 is withdrawn as stream 188, warmed by passage through main heat exchanger 101, and removed from the system in stream 189.

Refrigeration generated by the pulse tube refrigeration system is passed into the feed air and, with the feed air into the cryogenic rectification plant in a manner similar to that described in conjunction with FIG. 2. The numerals for the pulse tube refrigeration cycle illustrated in FIG. 3 are the same as those used in FIG. 2, and a description of the operation of the cycle will not be repeated.

Although the invention has been described in detail with reference to certain preferred embodiments, those skilled in the art will recognize that there are other embodiments of the invention within the spirit and the scope of the claims. For example many other cryogenic air separation plant arrangements can be used with the invention such as, for example, a double column with an argon sidearm column wherein product argon is produced.

What is claimed is:

1. A method for carrying out cryogenic rectification comprising:

(A) passing feed into a cryogenic rectification plant comprising at least one column;

(B) applying a compressive force to a pulse tube system gas to compress the pulse tube system gas, passing the compressed pulse tube system gas to a pulse tube, and expanding the pulse tube system gas within the pulse tube to generate refrigeration;

(C) passing refrigeration generated by the pulse tube system gas into the cryogenic rectification plant; and (D) separating the feed by cryogenic rectification within the cryogenic rectification plant using refrigeration generated by the pulse tube system gas.

2. The method of claim 1 wherein the feed is feed air.

3. The method of claim 1 wherein refrigeration is passed into the cryogenic rectification plant by withdrawing process fluid from a column of the cryogenic rectification plant, cooling the withdrawn process fluid by indirect heat exchange with pulse tube system gas, and passing the resulting cooled process fluid into a column of the cryogenic rectification plant.

4. The method of claim 3 wherein the withdrawn process fluid is at least partially condensed by the indirect heat exchange with the pulse tube system gas.

5. The method of claim 3 wherein the withdrawn process fluid is subcooled by the indirect heat exchange with the pulse tube system gas.

6. The method of claim 1 wherein refrigeration is passed into the cryogenic rectification plant by cooling heat exchange fluid by indirect heat exchange with pulse tube system gas, warming the resulting heat exchange fluid by indirect heat exchange with feed to cool the feed, and passing the cooled feed into a column of the cryogenic rectification plant.

7. The method of claim 6 wherein the cooling of the feed results in at least a fraction of the feed being condensed.

8. Apparatus for carrying out cryogenic rectification comprising:

(A) a cryogenic rectification plant comprising at least one column and means for passing feed into the cryogenic rectification plant;

(B) a pulse tube refrigeration system comprising a precooling means, a pulse tube, means for passing pulse tube system gas from the precooling means to the pulse tube, and means for applying a compressive force to the pulse tube system gas;

(C) means for passing refrigeration from the pulse tube refrigeration system into the cryogenic rectification plant; and (D) means for recovering product from the cryogenic rectification plant.

9. The apparatus of claim 8 wherein the means for passing refrigeration from the pulse tube refrigeration system into the cryogenic rectification plant comprises means for passing fluid from a column of the cryogenic rectification plant in indirect heat exchange relation with the pulse tube refrigeration system and then into a column of the cryogenic rectification plant.

10. The apparatus of claim 8 wherein the means for passing refrigeration from the pulse tube refrigeration system into the cryogenic rectification plant comprises a heat exchange fluid circuit in indirect heat exchange relation with the pulse tube refrigeration system and also in indirect heat exchange relation with the means for passing feed into the cryogenic rectification plant.

11. The apparatus of claim 8 wherein the cryogenic rectification plant comprises a double column.

12. The apparatus of claim 8 wherein the means for applying a compressive force to the pulse tube comprises a piston.

13. The apparatus of claim 8 wherein the means for applying a compressive force to the pulse tube comprises a thermoacoustic driver.

* * * * *